US006733226B1

(12) United States Patent
Bonin

(10) Patent No.: US 6,733,226 B1
(45) Date of Patent: May 11, 2004

(54) VEHICLE MOVING APPARATUS

(76) Inventor: Pete J. Bonin, 8816 Yuba Cir., #1110-C, Huntington Beach, CA (US) 92646

( * ) Notice: Subject to any disclaimer, the term of this patent is extended or adjusted under 35 U.S.C. 154(b) by 0 days.

(21) Appl. No.: 10/360,219

(22) Filed: Feb. 7, 2003

(51) Int. Cl.[7] ..... B65G 7/00
(52) U.S. Cl. ..... 414/429; 414/253
(58) Field of Search ..... 414/429, 426, 414/253

(56) References Cited

U.S. PATENT DOCUMENTS 3,160,393 A * 12/1964 Councilman ..... 254/93 R
3,680,718 A 8/1972 Miyachi
3,954,198 A * 5/1976 Sedelmayer ..... 414/429
4,919,445 A * 4/1990 Robey ..... 280/149.2
4,950,117 A 8/1990 Go
5,024,571 A 6/1991 Shahar et al.
5,173,027 A 12/1992 Trevisani

* cited by examiner

*Primary Examiner*—Khoi H. Tran
(74) *Attorney, Agent, or Firm*—Gene Scott - Patent Law & Venture Group

(57) ABSTRACT

A vehicle moving apparatus comprises a U-shaped, horizontally oriented, rigid frame having a transverse base frame joined at opposing ends thereof with spaced-apart, longitudinally oriented side frames. Frame wheels are engaged with the rigid frame for support and movement over a surface. The base frame and the side frames, together, define a vehicle space for placement of a vehicle wherein the vehicle is supported on its wheels. Each one of the side frames provides a proximal roller arm and a spaced apart distal roller arm. The arms are able to pivotally rotate between a stowed position within one of the side frames and a deployed position normal to one of the side frames. The arms are facilitated for adjustment of spacing between them, thereby enabling contact between the roller arms and the vehicle's wheels for lifting the vehicle onto the roller arms so that the vehicle may be moved to a designated location.

7 Claims, 5 Drawing Sheets

VEHICLE MOVING APPARATUS

RELATED APPLICATIONS

This application claims priority and is entitled to the filing date of U.S. non-provisional application Ser. No. 10/227,365 filed Aug. 22, 2002, and entitled "High Throughput Parking System" The content of the aforementioned application is incorporated by reference herein.

INCORPORATION BY REFERENCE: Applicant(s) hereby incorporate herein by reference, any and all U. S. patents, U.S. patent applications, and other documents and printed matter cited or referred to in this application.

BACKGROUND OF THE INVENTION

1. Field of the Invention

This invention relates generally to industrial moving devices such as fork-lift trucks, pallet movers and hoists, and more particularly to an automobile moving device for use in an automated garage system.

2. Description of Related Art

My prior patent application sited above teaches an automated, multi-level storage structure or garage for vehicles. The present invention teaches a vehicle moving apparatus that may be employed with the automated garage to great advantage. The following art is related to these subjects.

Examples of such prior art devices are found in:

U.S. Pat. No. 3,680,718 describes a multi-storied garage that is characterized in that a single lift cage is capable of serving a plurality of motor vehicle storage chambers located at a plurality of floor levels, and that appropriate means are provided for holding in position the motor vehicles to be stored in the storage chambers, whereby the motor vehicles can with the utmost safety be let into, kept in, and got out of, the garage.

Go, U.S. Pat. No. 4,950,117 describes a lift-space and multi-storied housing spaces providing on at least one side out of the left side, right side, front side, and rear side of the lift space. A three dimensional housing apparatus comprises a liftable fork unit composed of a pair of liftable forks movable up and down in the lift space, and a plurality of traversable housing forks each reciprocatingly movable between a corresponding housing space and the lift space. An object to be housed can speedily and safely be warehoused in and delivered from a respective housing space by the liftable fork unit and a respective traversable housing fork.

Shahar, et al., U.S. Pat. No. 5,024,571 describes an automatic multi-level storage structure including a building structure having at least one entrance and exit station, a main floor directly accessible from the entrance station, and a plurality of storage levels, a plurality of object pallets provided with wheels and adapted to carry objects to be stored. The pallets are movable along, and guide by, a first track fixedly attached to the floor of the levels. There is also provided at least one storage elevator adapted to accommodate the object pallets and to move between the main floor and the plurality of storage levels, and transfer platforms permanently located in the elevator and provided with a second track fixedly attached to the platform. The second track is adapted to accept and guide the wheels of the object pallet, and is furnished with a driver for moving the object pallet onto and off of the transfer platform.

Trevisani, U.S. Pat. No. 5,173,027 describes an underground circular and noncircular, parking place where vehicle parking areas are obtained and arranged radius-like on several underground stories. Vehicles are fed to the areas by a lift truck which moves vertically from ground story to the lower story and simultaneously rotates around a vertical axis together with the whole bearing column, to reach all parking areas; on ground story the lift truck is a continuity element with an incoming and an outgoing area; the lift truck consists of a platform on which an upper plane moves in two opposite directions, the plane has two pairs of chains abreast equipped with staves for motorcar supporting and hooking lists to avoid sliding; the ends of the plane are equipped with a mechanism for engaging with a corresponding mechanism in ground areas and underground spaces; the areas and spaces are also equipped with pairs of chains abreast and staves for motorcar support; a first motor for moving the plane in the two directions with respect to the platform are assembled and a second motor for rotating the chains of the plane and the chains of the parking area or underground space to which the plane is temporarily connected.

Clearly, then, there is a need for an automated vehicle moving apparatus for use with a parking facility to provide greater efficiency of operation. Such a needed mover is not taught in the prior art but is taught in the present invention.

SUMMARY OF THE INVENTION

The present invention teaches certain benefits in construction and use which give rise to the objectives described below.

A vehicle moving apparatus comprises a U-shaped, horizontally oriented, rigid frame having a transverse base frame joined at opposing ends thereof with spaced-apart, longitudinally oriented side frames. Frame wheels are engaged with the rigid frame for support and movement over a surface. The base frame and the side frames, together, define a vehicle space for placement of a vehicle wherein the vehicle is supported on its wheels. Each one of the side frames provides a proximal roller arm and a spaced apart distal roller arm. The arms are able to pivotally rotate between a stowed position within one of the side frames and a deployed position normal to one of the side frames. The arms are facilitated for adjustment of spacing between them, thereby enabling contact between the roller arms and the vehicle's wheels for lifting the vehicle onto the roller arms so that the vehicle may be moved to a designated location, for instance within a parking garage or automobile sales lot.

A primary objective of the present invention is to provide an apparatus and method of use of such apparatus that provides advantages not taught by the prior art.

Another objective is to provide such an invention capable of economically, and efficiently parking motor vehicles within a parking facility such as a parking garage or a parking lot.

A further objective is to provide such an invention capable of fully automated operation.

A still further objective is to provide such an invention capable of engaging a motor vehicle, lifting the vehicle by its tires, moving the vehicle over a distance to a selected parking space, lowering the vehicle to the parking surface and disengaging from the vehicle so as to move to engage a further vehicle.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

Figure 1:
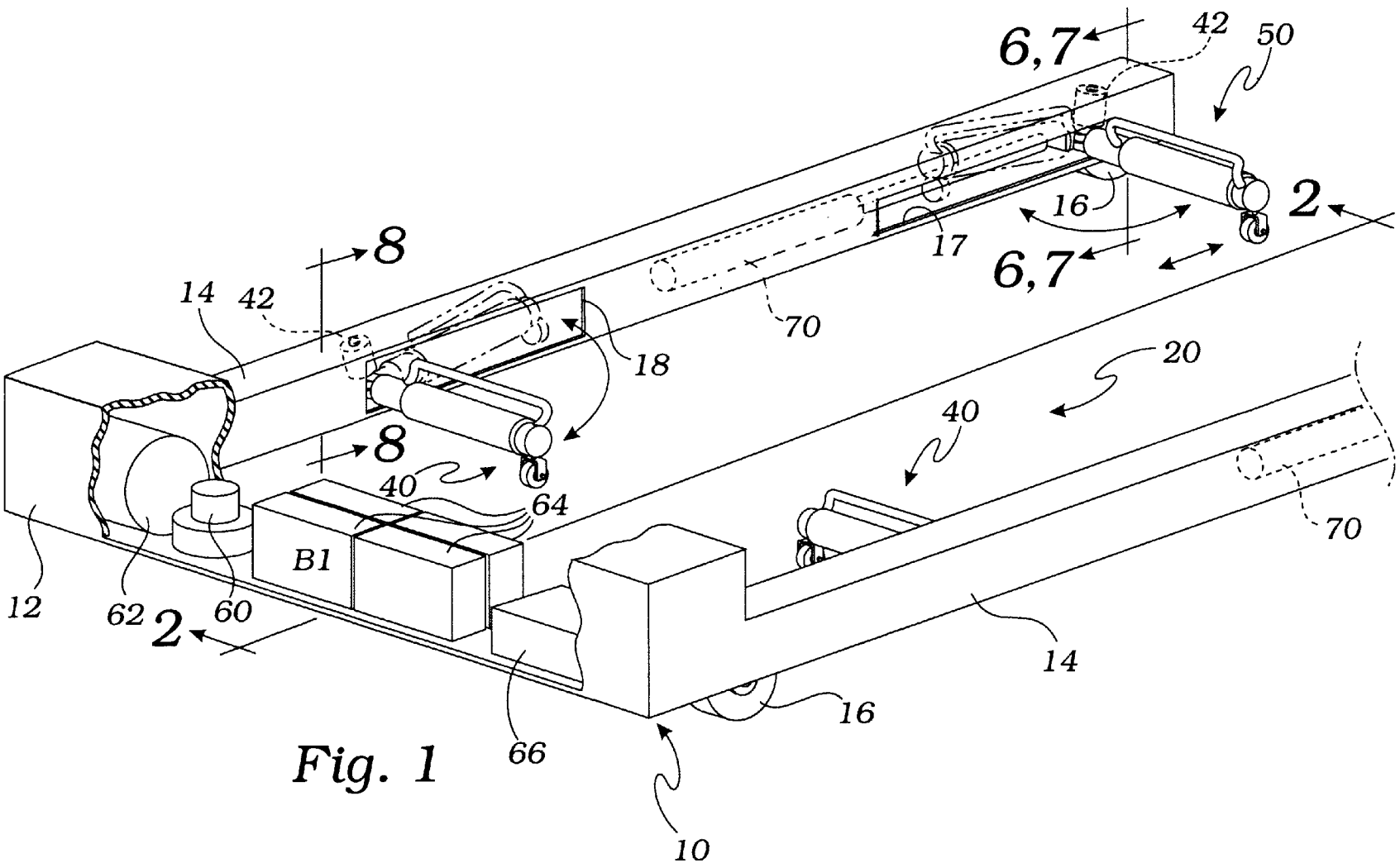
FIG. 1 is a perspective view of the preferred embodiment of the invention.

The above described drawing figures illustrate the invention in at least one of its preferred embodiments, which is further defined in detail in the following description.

The present invention is a vehicle moving apparatus comprising a U-shaped, horizontally oriented, rigid frame 10 having a transverse base frame 12 joined at opposing ends thereof with spaced-apart, longitudinally oriented side frames 14 wherein the spacing allows the frame 10 to be moved so as to position the side frames 14 on either side of an automobile or other vehicle having a width compatible with the structure of the frame 10, typically for moving automobiles in a parking garage. Frame wheels 16 are engaged with the rigid frame 10 for support thereof, for driving the apparatus from point to point within the parking garage, for instance, and for steering the apparatus. The base frame 12 and the side frames 14, together, define a vehicle space 20 of such size as to enable placement of a vehicle 30, such as a car that rolls on its own vehicle wheels 32, between the side frames 14, as shown in FIGS. 2–5.

Figure 2:
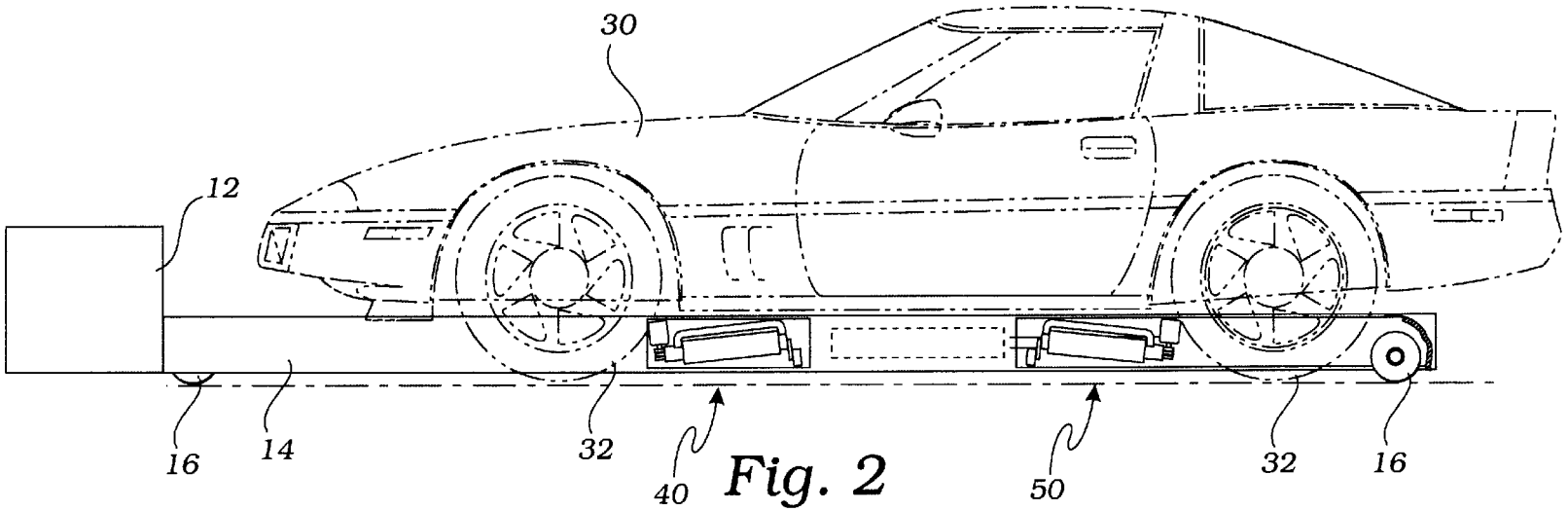
FIGS. 2–5 are side elevational views thereof illustrating the relationship between the invention and a motor vehicle and showing roller lifters of the invention, as stowed, deployed, extended and engaged respectively.
Figure 3:
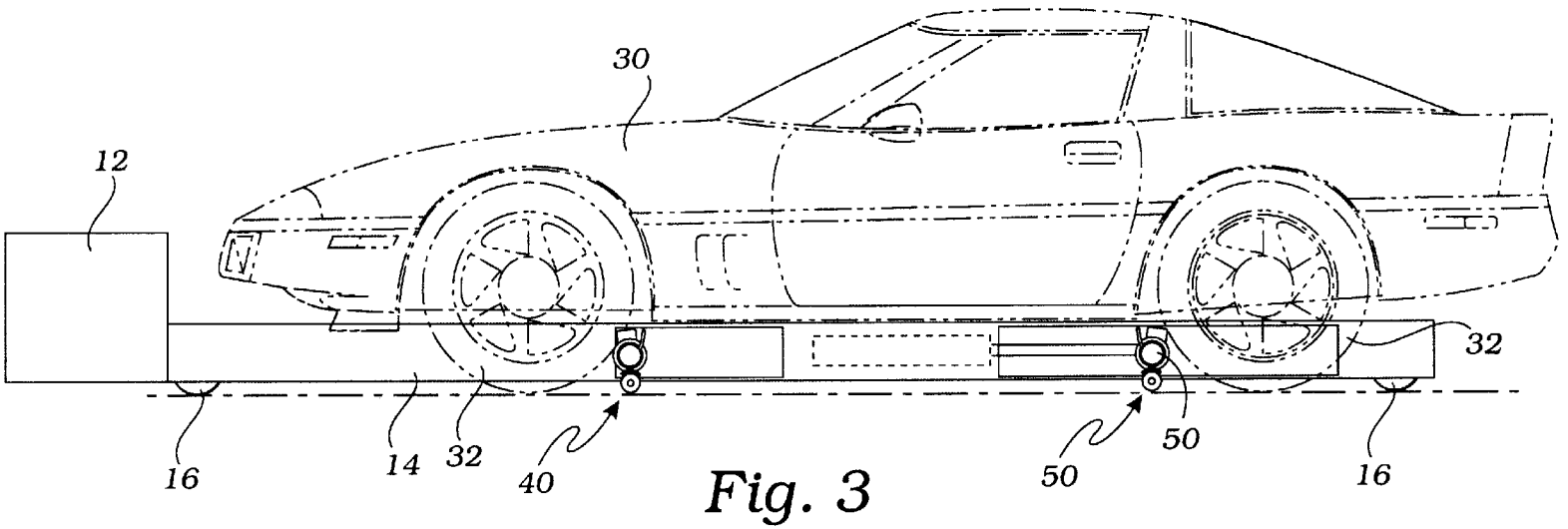

Each of the side frames 14 provides a proximal roller arm 40 and a spaced apart distal roller arm 50. A means for pivotally rotating 42, such as electrical actuation motors, of each one of the roller arms 40, 50 between a stowed position within one of the side frames 14, as shown in FIG. 2, and a deployed position normal to the side frames 14, as shown in FIG. 3, is provided as shown. A means for adjustment 70 of spacing between the distal 50 and the proximal 40 roller arms is preferably a linear hydraulic actuator. This enables the roller arms 40, 50 to be brought into contact with the vehicle wheels 32 for lifting the vehicle 30 onto the roller arms 40, 50 prior to moving the vehicle 30.

A means for driving and steering the apparatus over a surface for moving the apparatus and the vehicle as supported by the roller arms 40, 50 is provided and comprises any well known drive mechanism such as an electric motor (not shown) engaged with one or more of the wheels 16, and any well known steering mechanism (not shown) such as is used for fork-lift trucks and such, for steering the wheels 16, preferably those supporting the base frame 12.

The roller arms 40, 50 are horizontal when in the deployed position and are angled upwardly when in the stowed position as is clearly shown in FIG. 1. This is facilitated by mounting the actuation motor 42 and its coupling 44 to the roller arms 40, 50 at an angle as shown best in FIGS. 6–8. In this manner, the roller arms 40, 50 are able to be easily stowed within the side frames 14 at an elevated position that is clear of the parking surface.

Figure 4:
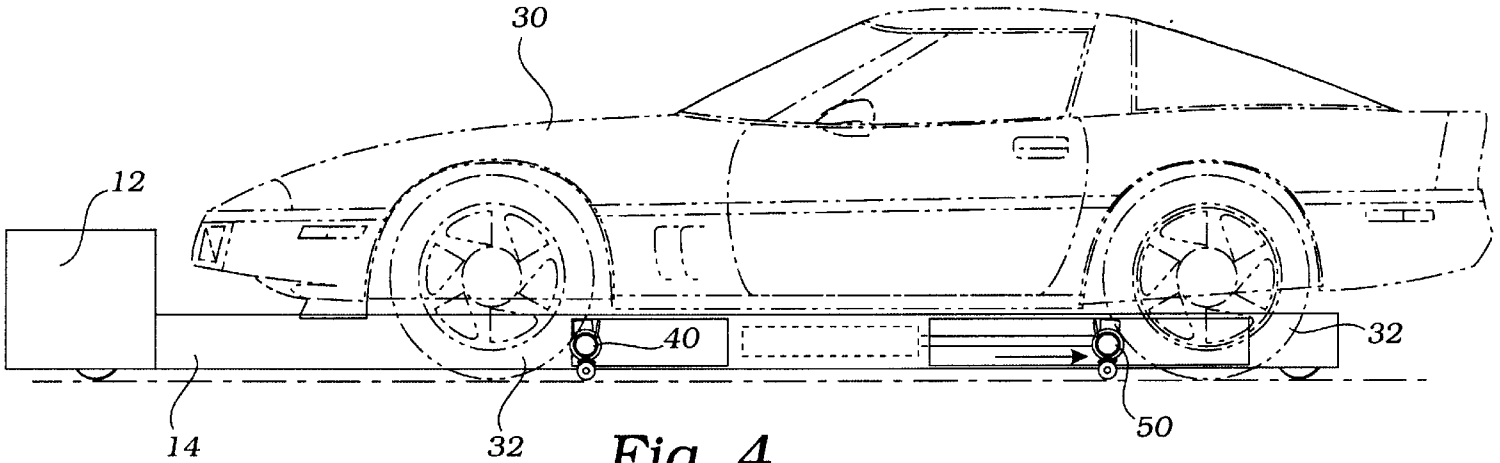
Figure 5:
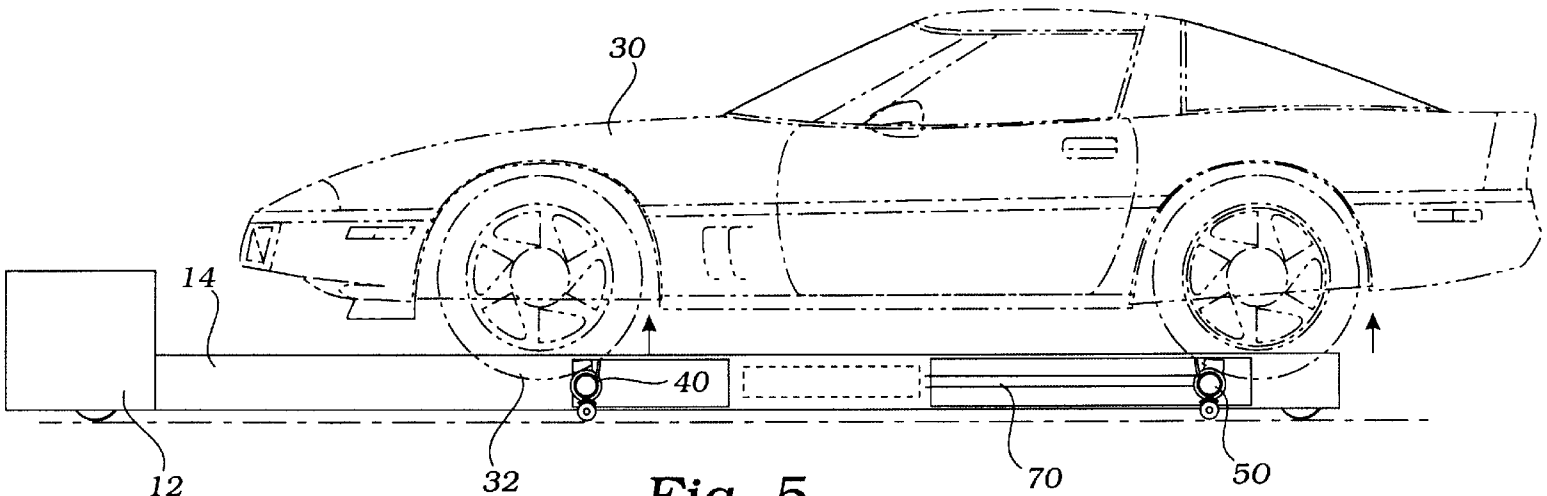

The roller arms 40, 50 preferably each comprise an exterior roller sheath 41, wherein the roller sheath 41 is free to rotate about a fixed roller core 43 on roller bearings 45. A wheel stop 46 is fixed to the roller core 43, as shown, the wheel stop 46 adapted and positioned for chocking one of the vehicle wheels 32 when it is mounted atop the roller sheath 41. This prevents the vehicle wheel 32 from rolling over the roller arm 40 or 50. A caster wheel 52 is mounted to a terminal end of each of the roller cores 43 and the caster wheel 52 is positioned so that it is in contact with the parking surface when the roller arm 40, 50 is in the deployed position as shown in FIGS. 3–5. The caster wheel 52 supports the roller arm 40, 50 under the weight of the vehicle and yet is able to turn to follow the movements of the apparatus in moving the vehicle 30 from placed to place.

Figure 6:
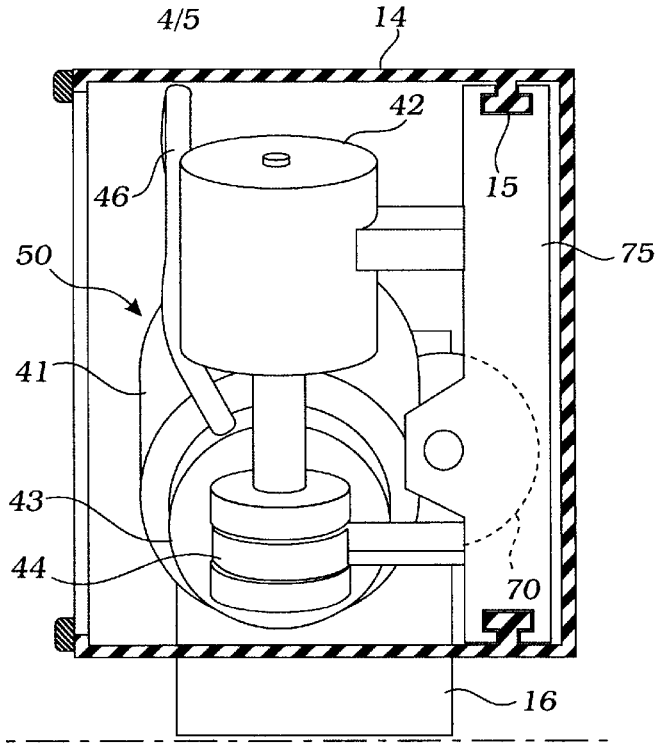
FIGS. 6 and 7 are a section view thereof taken along lines 6—6 and 7—7 respectively in FIG. 1 and showing a distal one of the roller lifters in the stowed position and in the deployed position respectively.
Figure 7:
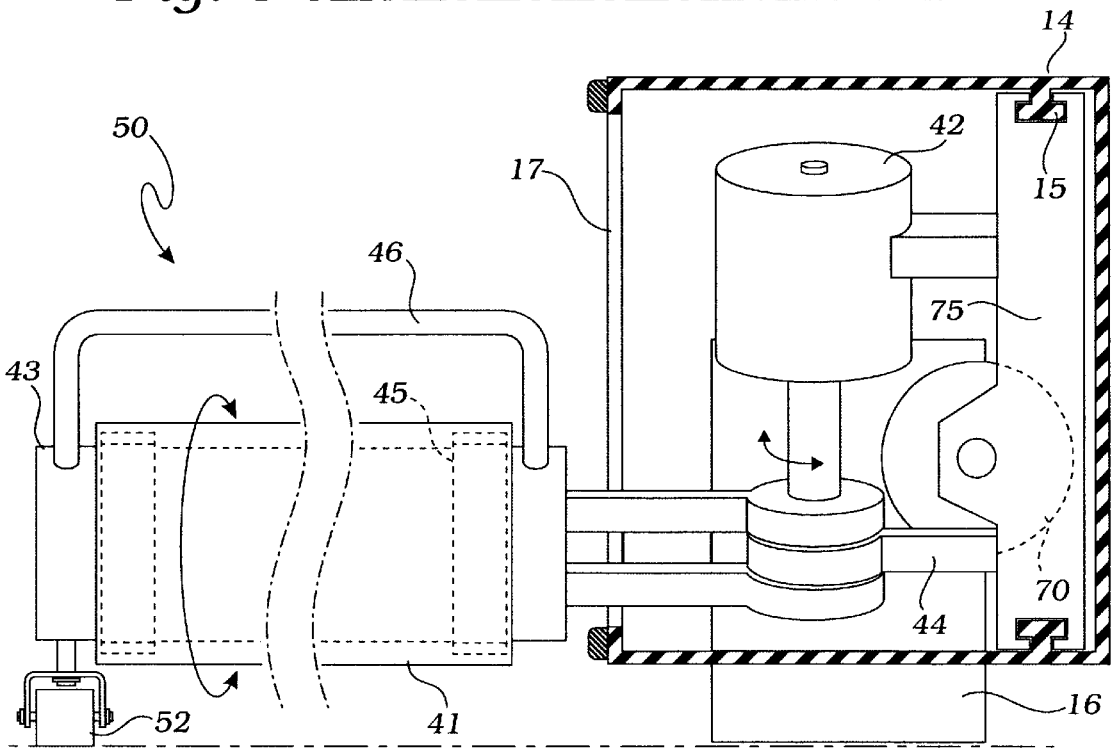
Figure 8:
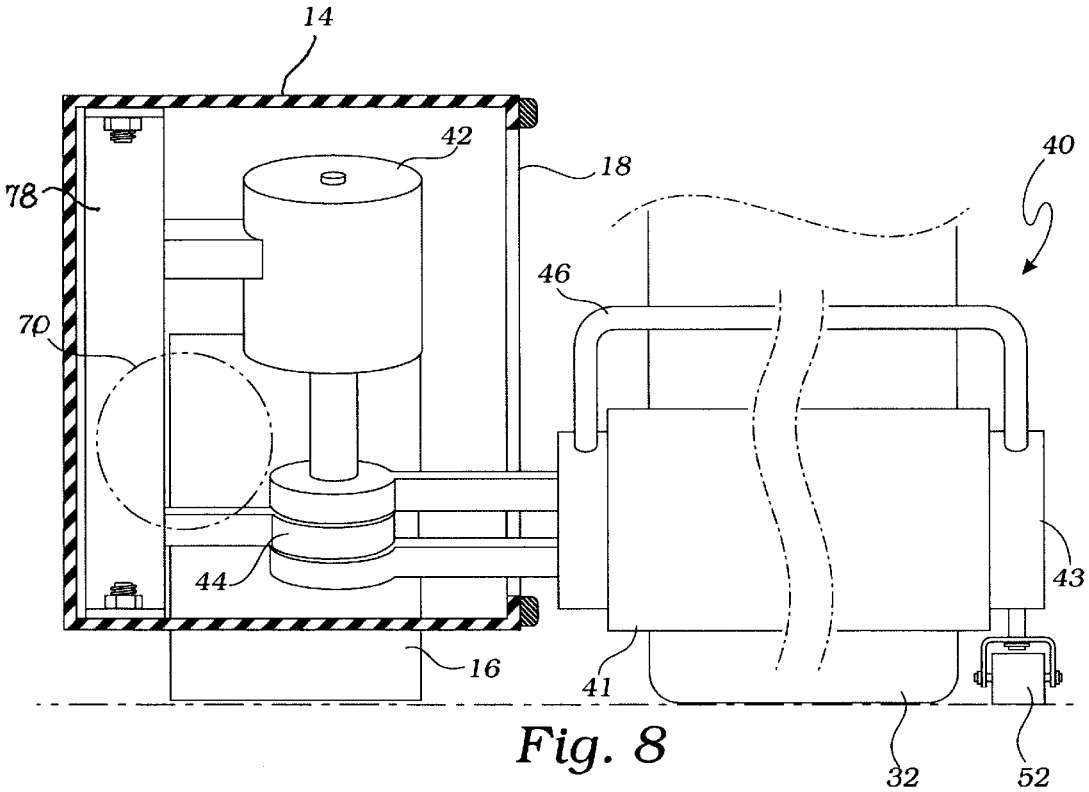
FIG. 8 is a section view thereof taken along line 8—8 in FIG. 1 showing a proximal one of the roller lifters in the deployed position.

To facilitate operation of the apparatus further components are provided including a hydraulic pump 60, hydraulic fluid tank 62, electrical battery 64 and a control system 66, all shown in FIG. 1 wherein the casing of the base frame is cut-away to show these interior components. The control system 66 is preferably a computer control apparatus as is well known and used in industry for controlling industrial processes. Such a computer is easily programmed to perform the simple tasks required of the subject apparatus. Preferably, the means for adjustment 70 of spacing between the distal 50 and the proximal 40 roller arms comprises hydraulic linear actuators, as shown, enabled by the hydraulic pump 60 as fed by the hydraulic fluid tank 62 and controlled by the control system 66. The means for pivotally rotating 42 of each one of the roller arms 40, 50 preferably comprises an electrical motor, as shown, powered by the electrical battery 64 and controlled by the control system 66. In FIGS. 6 and 7 is shown the preferred manner in which the roller arms 50 are moved longitudinally along the side frame 14. Trolley 75 is mounted on to rails 15 and is able to move as pushed and pulled by linear actuator 70, shown in phantom line. Aperture 17 enables both the longitudinal motion of the roller arm 50 and the entrance for stowing the roller arm 70 as shown in FIG. 6. As can be seen in FIG. 8, the roller arms 40 do not travel, but instead are fixed onto structural member 78. Access to the interior of side frame 14 is enabled by aperture 18. FIG. 8 also shows the relative position of vehicle wheel 32 with respect to roller arm 40 prior to mounting the wheel 32 onto the roller arm 40.

The apparatus may be operated fully automatically by enabling sensing of a track in the parking surface or in the ceiling through magnetic or other well known means and by providing optical sensors to enable the apparatus to align itself at one end of the vehicle and to enable sensing when the vehicle has moved to a position where the roller means 40, 50 may be deployed between the vehicle 30 wheels 32. Such sensors and feedback control is well known in the art and may be easily integrated with the control system 66. Alternatively, the apparatus may be operated by an operator either walking or riding on the frame 10 where a seat may be mounted on the base frame 12.

Figure 9:
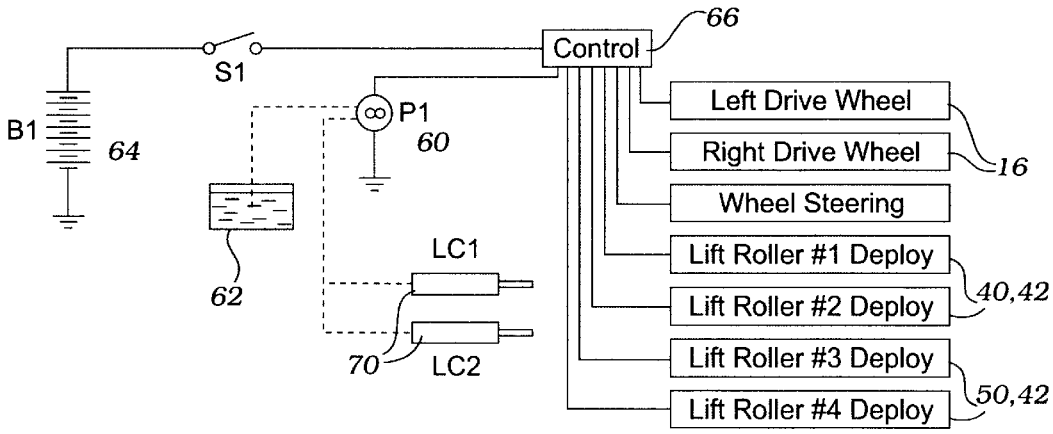
FIG. 9 is a schematic diagram thereof showing electrical connections in solid lines and hydraulic fluid connections in dashed lines.

It should be noticed that the side frames 14 are low enough to avoid contact with elements of the vehicle such as door handles, external mirror mounts and such, and that the roller arms are low enough to avoid contact with the body of the vehicle, that is for vehicles that have not be lowered or otherwise altered. Optical sensors would be used to assure that the apparatus does not try to engage a vehicle that does not provide enough clearance or is too wide. FIG. 9 shows in schematic form, the interconnections of the control system 66 to provide power from battery B1 (64) through switch, S1 to the drives for wheels 16 and the motors 42 for roller arms 40, 50. Also shown is hydraulic pump P1 (60) and tank 62 for actuation of linear actuation devices LC1 and LC2 (70) which are preferably hydraulic cylinders.

The method of operation of the above described apparatus comprises the steps of rolling the vehicle moving apparatus to a position wherein the side frames 14 of the moving apparatus are aligned for being moved into positions adjacent to opposing sides of the vehicle 30 to be moved. This means that the apparatus is not yet engaged about the vehicle 30, but is positioned at one end of the vehicle, preferably the front end, which means that the base frame 12 is positioned to be brought into adjacency with the front end of the vehicle as shown in FIGS. 2–5. Next, the apparatus is moved toward the vehicle 30 until the distal roller arms 50 are positioned between front and rear wheels 32 of the vehicle 30. At this point, the distal roller arms 50 are rotated from stowed positions (FIG. 2) within the side frames 14 to deployed positions (FIG. 3) normal to the side frames 14 and are positioned between the front and rear wheels 32 of the vehicle 30. Next, the apparatus is moved further toward the vehicle until the proximal roller arms 40 of the apparatus are positioned between the front and rear wheels 32 of the vehicle 30. The proximal roller arms 40 are then rotated from their stowed positions within the side frames 14 to deployed positions normal to the side frames 14 and positioned between the front and rear wheels 32 of the vehicle 30. Finally, the apparatus is moved toward the vehicle further until the proximal roller arms 40 are in contact with the wheels 32 of the vehicle 30 that are closest to the base frame 12. At this time, the distal roller arms 50 are moved along the side frames 14 until they are in contact with opposing wheels 32 of the vehicle 30. This is accomplished by linear actuators 70 until the wheels 32 of the vehicle 30 are forced to mount on top of the roller arms 40, 50. Because the exterior roller sheaths 42 are free to rotate, the vehicle wheels 32 are easily mounted onto the roller arms 40, 50.

With the vehicle 30 mounted onto the respective roller arms 40, 50 at front and rear of the vehicle 30, the apparatus is able to now move the vehicle to a selected location. Disengaging the vehicle from the apparatus is accomplished in reverse order from the above methods.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A vehicle moving apparatus comprising: a U-shaped, horizontally oriented, rigid frame having a transverse base frame joined at opposing ends thereof with spaced-apart, longitudinally oriented side frames; frame wheels engaged with the rigid frame for support thereof; the base frame and the side frames, together, defining a vehicle space for placement of a vehicle wherein the vehicle is supported on vehicle wheels; each one of the side frames providing a proximal roller arm and a spaced apart distal roller arm; means for pivotally rotating each one of the roller arms between a stowed position within one of the side frames and an deployed position normal to one of the side frames; means for adjustment of spacing between the distal and the proximal roller arms, thereby enabling contact between the roller arms and the vehicle wheels for lifting the vehicle onto the roller arms.

2. The apparatus of claim 1 wherein the roller arms are horizontal when in the deployed position and are angled upwardly when in the stowed position.

3. The apparatus of claim 1 wherein the roller arms each comprise an exterior roller sheath, wherein the roller sheath is free to rotate about a fixed roller core.

4. The apparatus of claim 3 wherein the roller arms each comprise a wheel stop fixed to the roller core, the wheel stop adapted and positioned for chocking a vehicle wheel mounted atop the roller sheath.

5. The apparatus of claim 1 wherein the roller arms each comprise a caster wheel mounted to a terminal end thereof, the caster wheel in contact with a support surface when the roller arm is in the deployed position.

6. The apparatus of claim 1 further comprising a hydraulic pump, hydraulic fluid tank, electrical battery and control system, the means for adjustment of spacing between the distal and the proximal roller arms comprising hydraulic linear actuators enabled by the hydraulic pump as fed by the hydraulic fluid tank and controlled by the control system, the means for pivotally rotating each one of the roller arms comprising an electrical motor powered by the electrical battery and controlled by the control system.

7. A vehicle moving method comprising the steps of: rolling a vehicle moving apparatus to a position wherein side frames of the moving apparatus are aligned for being moved adjacent to opposing sides of a vehicle; moving the apparatus toward the vehicle until distal roller arms of the apparatus are positioned between front and rear wheels of the vehicle; rotating the distal roller arms from stowed positions within the side frames to deployed positions normal to the side frames and positioned between the front and rear wheels of the vehicle; moving the apparatus further toward the vehicle until proximal roller arms of the apparatus are positioned between the front and rear wheels of the vehicle; rotating the proximal roller arms from stowed positions within the side frames to deployed positions normal to the side frames and positioned between the front and rear wheels of the vehicle; moving the apparatus until the proximal roller arms are in contact with wheels of the vehicle; moving the distal roller arms into contact with opposing wheels of the vehicle; moving the distal roller arms away from the proximal roller arms until the wheels of the vehicle are mounted on top of the roller arms; moving the apparatus to a selected location for the vehicle; stowing the roller arms and disengaging the apparatus from the vehicle.

* * * * *